United States Patent [19]

Zwicker

[11] Patent Number: 4,967,481

[45] Date of Patent: Nov. 6, 1990

[54] ALIGNABLE SENSOR

[75] Inventor: Wolfgang Zwicker, Berlin, Fed. Rep. of Germany

[73] Assignee: Dipl.-Ing Wolfgang Zwicker GmbH & Co., Berlin, Fed. Rep. of Germany

[21] Appl. No.: 435,541

[22] Filed: Nov. 13, 1989

[30] Foreign Application Priority Data

Nov. 17, 1988 [DE] Fed. Rep. of Germany ..... 8814393

[51] Int. Cl.[5] ..... B43L 00/00

[52] U.S. Cl. ..... 33/572; 33/559

[58] Field of Search ..... 33/559, 561, 572, 556, 33/558, 503, 504

[56] References Cited

U.S. PATENT DOCUMENTS 3,478,436 11/1969 Barnes ..... 33/503

3,678,584 7/1972 Dolan ..... 33/559 X 4,807,152 2/1989 Lane et al. ..... 33/503 X

*Primary Examiner*—Harry N. Haroian

*Attorney, Agent, or Firm*—Edwin D. Schindler

[57] ABSTRACT

An alignable sensor, the connecting housing of which receives within a passage rotatably a stub of a prismatic intermediate piece, the intermediate piece comprising a holding plate aligned at an angle of 45° to the axis of the connecting piece and to a side wall, for a sensor head, and the sensor head and the intermediate piece having in common a parallelepiped contour. The passage comprises a plurality of locking recesses for fixing noses of the connecting piece. Catch curves of the stub cooperate with catch profiles of the connecting housing, in order to hold, in a catching manner, the stub in the axial direction. The holding plate rotatably receives a flange of the sensor head.

8 Claims, 5 Drawing Sheets

ALIGNABLE SENSOR

BACKGROUND OF THE INVENTION

FIELD OF THE INVENTION

The invention relates to an alignable sensor, the connecting housing of which receives within a passage rotatably a stub of a prismatic intermediate piece, the intermediate piece comprising a holding plate aligned at an angle of 45° to the axis of the connecting piece and to a side wall, for a sensor head, and the sensor head and the intermediate piece having in common a parallelepiped contour.

A sensor of this type enables, after the releasing of fixing screws, a turning of the intermediate piece and a displacing of the sensor head so that it is possible thereby to adjust the sensor head into different directions. A fixing is effected by the fixing screws. In this connection the operation of the fixing screws is very complicated and time-consuming. The fixing screws may get lost. Also the removing of the sensor head is disadvantageous due to the fact that damage of the electrical connecting cables is possible.

SUMMARY OF THE INVENTION

One object of the invention is such a configuration of the sensor that a release is possible without any tools and that the parts maintain a coherence also in the released position.

According to the invention this object is solved by the following features:

(a) the passage comprises a plurality of locking recesses for fixing noses of the connecting piece;

(b) catch curves of the stub cooperate with catch profiles of the connecting housing, in order to hold, in a catching manner, the stub in the axial direction;

(c) the holding plate rotatably receives a flange of the sensor head.

The invention differs from the prior art in that the parts are kept together in an locking manner. The intermediate piece can be drawn out into a adjusting position. In this adjusting position the sensor head is substantially freely rotatable. An alignment of the sensor head is carried out by cooperating surfaces of the sensor head and of the connecting housing. For the alignment of the intermediate piece and of the sensor head just a single arresting is necessary.

An easy assembly of the sensor head on the intermediate piece is secured in that the holding plate comprises a circular opening with at least one radial projection. The radial projection secures a sufficient elasticity of the circular opening when pressing the flange of the sensor head in.

An overturning of the sensor head is avoided in that the circular opening comprises, over a circumferentioal arc of at least 180°, an annular step, engaged by a limiting nose of the flange of the sensor head.

The radial locking of the intermediate piece is reached in that the locking recesses are provided on the front face of the passage.

An overturning of the intermediate piece is avoided in that a locking recess extends over the axial length of the passage and renders possible the inserting of a limiting nose on the front end of the connecting piece.

A rotational limitation over a larger axial portion is reached in that the limiting nose cooperates with a limiting web within the connecting housing.

An immediate catching is guaranteed in that the catch profiles are provided as circumferential grooves of the connecting piece.

The catching is made very simple in that within the connecting housing two pins situated opposite to each other in regard to the axis of the connecting piece, are arranged which, together with the circumferential grooves, determine the catch positions of the intermediate piece.

BRIEF DESCRIPTION OF THE DRAWINGS

One embodiment of the invention will be described in the following with reference to the accompanying drawings, wherein.

DESCRIPTION OF THE PREFERRED EMBODIMENT

Figure 1:
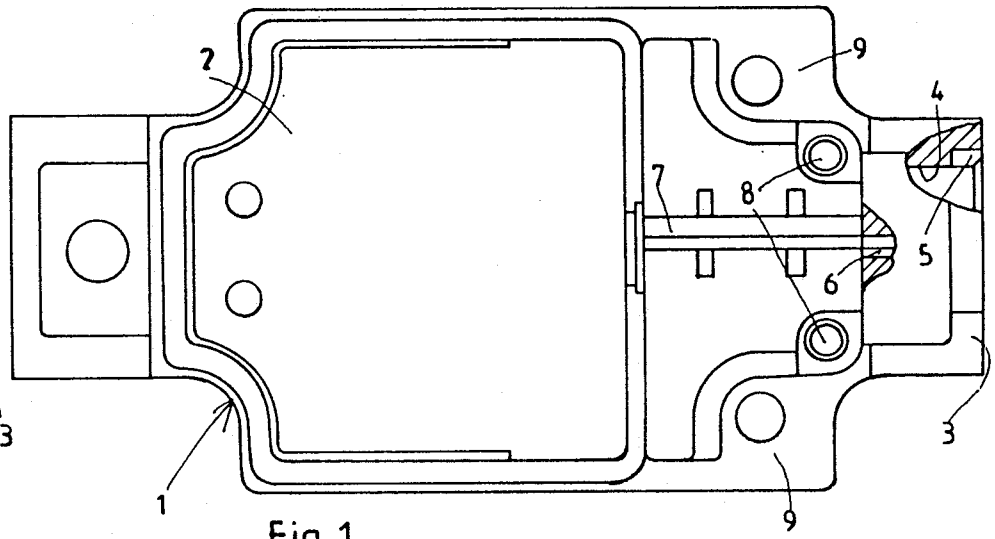
FIG. 1 is a top view to the connecting housing, the housing cover removed.
Figure 2:
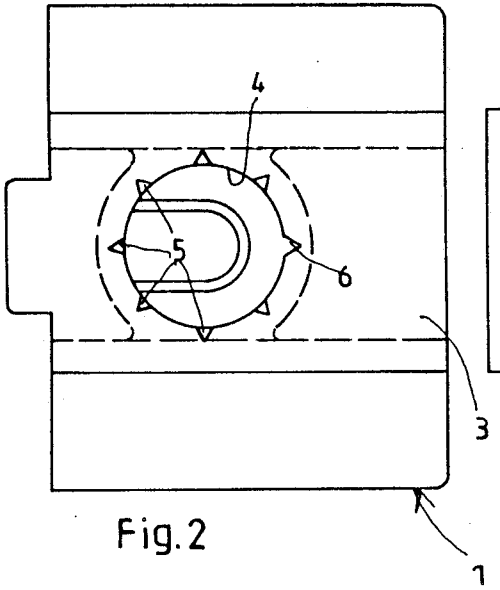
FIG. 2 is a side view in regard to FIG. 1.

In the Figures merely the housing components without the electronical installation plants, line connections, sensor parts and the like are shown. The housing components are provided preferably as injection molded parts.

The connecting housing 1 is formed substantially rectangularly and encloses an inner space 2 for the reception of electronical elements as well as of connecting terminals and the like. In a side wall 3 a passage 4 is provided, comprising a substantially circular cross-section. In the front face of this passage a plurality of locking recesses 5 are arranged in equal angular distances. One recess is provided as a continuous groove 6. Approximately to this groove 6, in parallel with the longitudinal axis of the passage 4, a limiting web 7 is provided. In a plane vertically to the axis of the passage two catch pins 8 are provided which project into the free space of passage 4, as is particularly evident from FIG. 4.

Figures 3, 4:
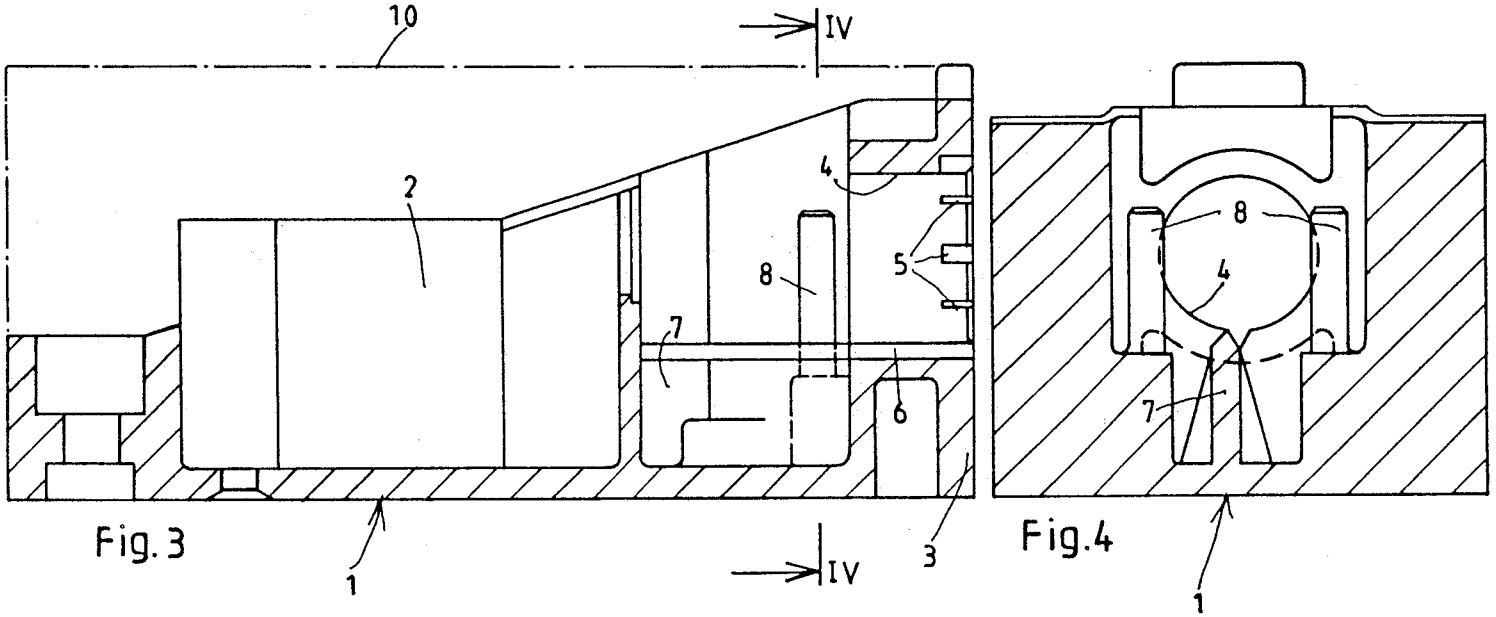
FIG. 3 is a section through the connecting housing.
FIG. 4 is a section along line IV—IV in FIG. 3.

The connecting housing 1 comprises a plurality of eyes 9 for the reception of fastening screws of a housing cover 10, which is shown schematically in FIG. 3. The side wall 3 terminates in a plane surface vertically to the axis of the passage 4.

Figure 5:
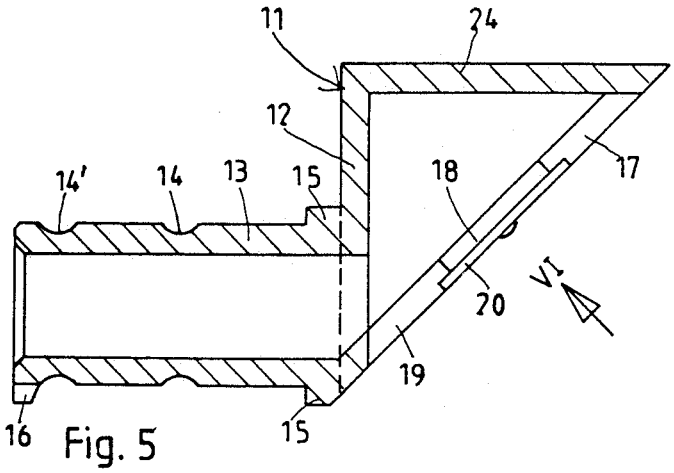
FIG. 5 is a section through the intermediate piece.

An intermediate piece 11 according to FIG. 5 is of a substantially prismatic shape. On a plane side wall 12 of the intermediate piece 11 a cylindrical stub 13 having two circumferential grooves 14 and 14' as catch profiles is positioned. At the foot of the stub 13, at least, two fixing noses 15 are provided which fit in the locking recesses 5. The stub 13 can be pushed into the passage 4. A limiting nose 16 is situated on the front end of the stub 13. Thereby the limiting nose 16 extends through the groove 6. When pushing the intermediate piece 11 in, the catch pins 8 initially snap into the circumferential groove 14'. The stub 13 is rotatable in this position. In the case of further pushing into the fixing position the catch pins 8 snap into the circumferential groove 14. The limiting nose 16 cooperates with the limiting web 7 and limits rotation of the intermediate piece 11 to an angle range of less than 360°. Thereby it is avoided that the intermediate piece 11 can be turned without limitation. That would be detrimental for the electrical connecting lines passed through.

Figure 6:
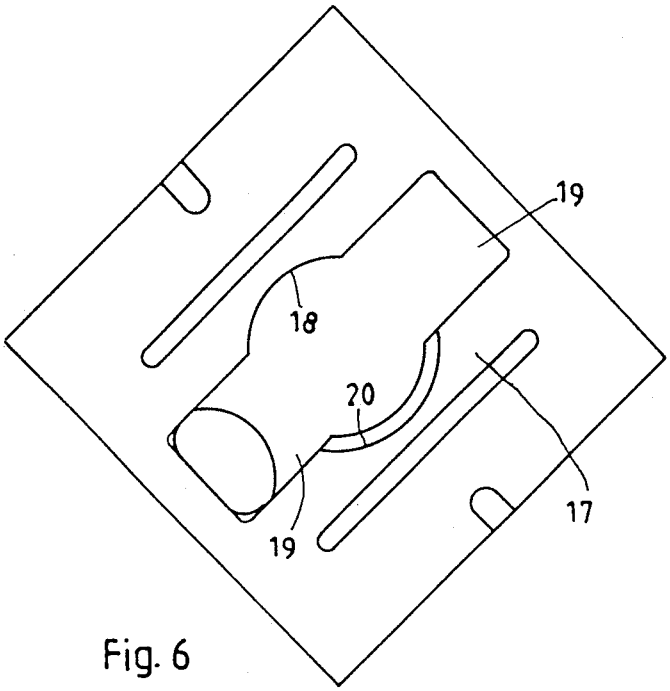
FIG. 6 is a view in arrow direction VI.

At the side wall 12 a side wall 24 extends at a right angle. A holding plate 17 connects these side walls 12 and 24 and encloses with each side wall an angle of 45°. The holding plate 17 extends also at an angle of 45° to the axis of the stub 13. FIG. 6 shows a view of the holding plate 17. A circular opening 18 with two slot-like radial extensions 19 and an annular step 20 on one side of the circular opening 18 is shown.

Figure 7:
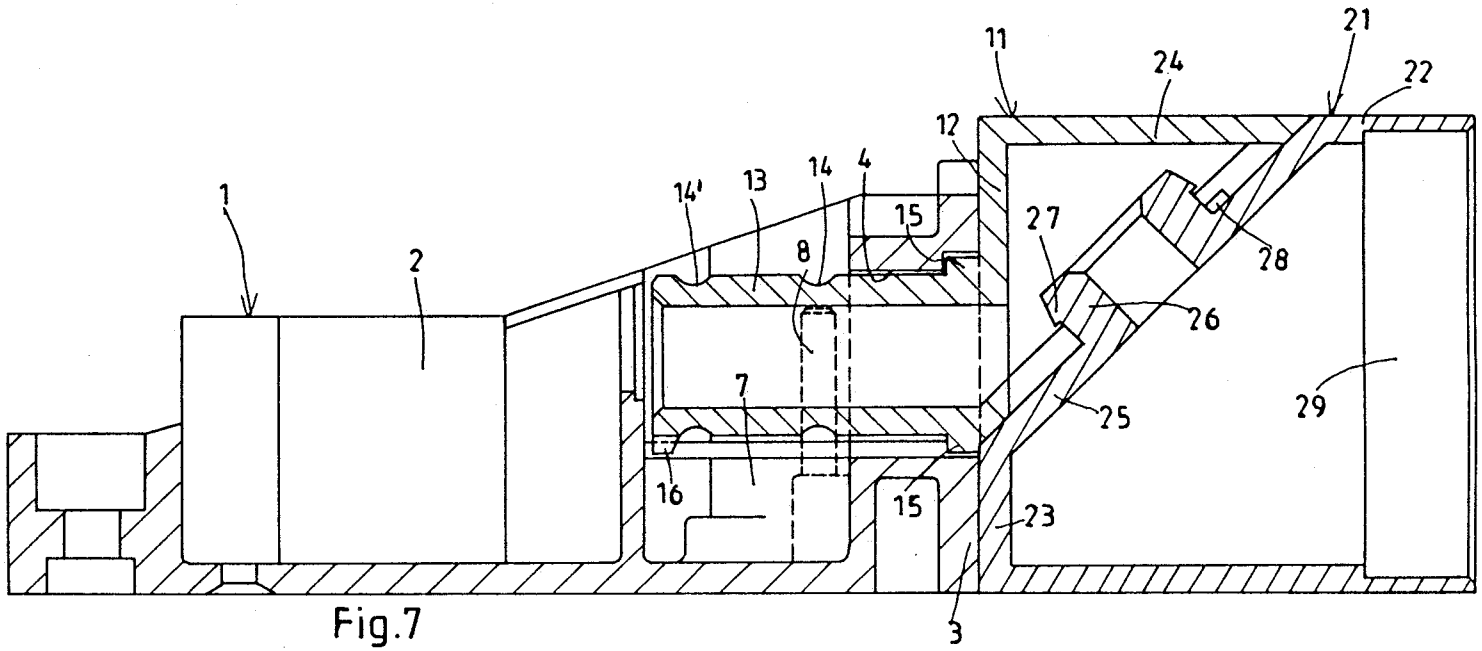
FIG. 7 is a total view of the sensor in fixed position, whilst
Figure 8:
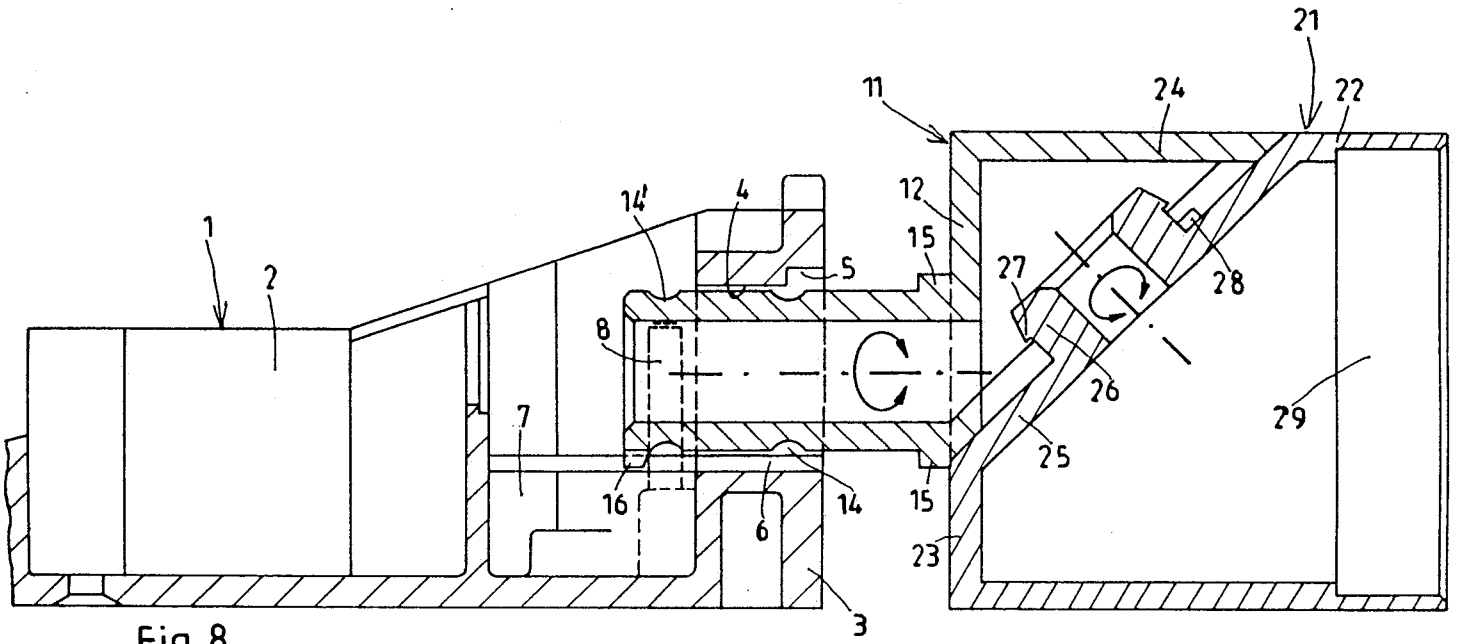
FIG. 8 is a corresponding total view in adjusting position.

The sensor itself, e.g. a proximity sensor, is arranged in a sensor head 21, which is shown in FIG. 7 and 8. The sensor head 21 is provided also substantially in the shape of a prism and forms together with the intermediate piece 11 a parallelepiped body. Side walls 22 and 23 of the sensor head are aligned to the side wall 12 and 24, respectively, of the intermediate piece. The sensor head receives within a reception collar 29 the sensor, not shown. A side wall 25 extends at an angle of 45° in regard to the side walls 22 and 23 and is arranged next to the holding plate 17. The side wall 25 carries centrally a flange 26 with an untercut front collar 27. A limiting nose 28 is positioned at the foot of the flange 26. The flange 26 can be pressed into the circular opening 18, the front collar 27 snapping over the edge of the circular opening 18. The limiting nose 28 finds place in the annular step 20 and limits the rotation of the sensor head 21 to an angle range less than 360°.

The sensor head is pressed into the intermediate piece 11 in the manner as shown. Then the intermediate piece 11 is introduced with the stub 13 into the passage 4 and is fixed in the fixing position according to FIG. 7, the catch pins 8 engaging the circumferential groove 14 in a locking manner. The radial alignment of the intermediate piece is performed by means of the fixing noses 15 in the desired position. The sensor head 21 thereby contacts, with the side wall 23, the side wall 3 so that thereby also the sensor head 21 is fixed in the position as illustrated.

For the adjusting or readjusting of the sensor head the intermediate piece 11 is drawn out so far according to FIG. 8 that the catch pins 8 engage the circumferential groove 14'. In this position the intermediate piece 11 can be turned, this rotation being limited by the limiting web 7. The sensor head 21 can be rotated about the axis of the flange 26 by 180° so that the sensor is aligned within the reception collar 29 at an angle of 90° in regard to the position as indicated in FIG. 8. In this position the side wall 22 of the sensor head contacts the side wall 12 of the intermediate piece 11. After this adjustment of the sensor head the intermediate piece 11 is pushed again into the passage so that the catch pins 8 engage the circumferential groove 14. Now the sensor is fixed in this new alignment.

Thus, one catching of the intermediate piece is sufficient, in order to guarantee a thorough and precise adjustment of the sensor head. The invention limits the specific rotation of the connecting piece of the intermediate piece 11 and of the flange of the sensor head 21 so that any overturning or kinking of connecting lines is excluded.

We claim the following:

1. An alignable sensor, comprising:

a connecting housing having a side wall with a passage therein, said passage including a plurality of locking recesses, said connecting housing further including catch profiles;

a sensor head having a flange;

a prismatic intermediate piece having a connecting piece and a holding plate, said connecting piece having fixing noses for attachment with said plurality of locking recesses of said passage and said connecting piece further including catch curves which are capable of cooperating with said catch profiles of said connecting housing in order to hold, in a catching manner, said connecting piece in an axial direction, said holding plate of said prismatic intermediate piece being aligned at an angle of 45° to an axis of the connecting piece and to the side wall of the passage of the connecting housing, for the sensor head with said sensor head and said prismatic intermediate piece having, in common, a parallelepiped contour, said holding plate being capable of rotatably receiving the flange of said sensor head, said connecting housing capable of receiving within said passage rotatably said connecting piece of said prismatic intermediate piece.

2. The alignable sensor according to claim 1, wherein said holding plate includes a circular opening with at least one radial projection.

3. The alignable sensor according to claim 2, wherein said circular opening includes, over a circumferential arc of at least 180°, an annular step engaged by a limiting nose of the flange of said sensor head.

4. The alignable sensor according to claim 1, wherein said plurality of locking recesses are provided on a front face of said passage.

5. The alignable sensor according to claim 4, further comprising a limiting nose on a front end of said connecting piece wherein a locking recess of said plurality of locking recesses has a groove which extends over an axial length of said passage for the insertion of the limiting nose on the front end of said connecting piece.

6. The alignable sensor according to claim 5, further comprising a limiting web with said connecting housing wherein said limiting nose cooperates with said limiting web.

7. The alignable sensor according to claim 1, wherein said catch profiles of said connecting housing are provided as circumferential grooves of said connecting piece.

8. The alignable sensor according to claim 7, further comprising two pins located within said connecting housing, said two pins being situated opposite to each other in regard to an axis of said connecting piece, said two pins being arranged, along with said circumferential grooves, so as to determine catch positions of said intermediate piece.

* * * * *